United States Patent [19]

Wieland

[11] Patent Number: 4,698,943

[45] Date of Patent: Oct. 13, 1987

[54] BASE SHIELD FOR BUILDINGS

[76] Inventor: Karl W. Wieland, 41 Brimfield Rd., Norristown, Pa. 19403

[21] Appl. No.: 906,810

[22] Filed: Sep. 12, 1986

[51] Int. Cl.[4] ..... E02D 27/00

[52] U.S. Cl. .....52/102; 52/169.5

[58] Field of Search ..... 52/102, 169.14, 169.5

[56] References Cited

U.S. PATENT DOCUMENTS

| | | | |
|---|---|---|---|
| 775,791 | 11/1904 | Austin . | |
| 2,078,864 | 4/1937 | Macatee . | |
| 2,471,226 | 5/1949 | Maccario . | |
| 2,729,093 | 1/1956 | Ridley | 52/102 |
| 2,826,393 | 3/1958 | Miller . | |
| 3,052,248 | 9/1962 | Reuter . | |
| 3,087,279 | 4/1963 | Thompson . | |
| 3,271,913 | 9/1966 | Fields | 52/169.5 X |
| 3,495,352 | 2/1970 | Sbare . | |
| 3,745,701 | 7/1973 | Marvin | 52/102 X |
| 3,945,747 | 3/1976 | Cruz . | |
| 4,463,529 | 8/1984 | Singer et al. | 52/169.5 |

*Primary Examiner*—Carl D. Friedman

[57] ABSTRACT

A shield for use along the base of a building to deflect rain water, restrict vegetation and preserve termite control chemicals which shield is composed of a plurality of end-to-end abutting slabs having a sloped upper surface, an angled inner face and lower surface which includes a toe.

2 Claims, 4 Drawing Figures

BASE SHIELD FOR BUILDINGS

FIELD OF THE INVENTION

This invention relates to the protection of the base of buildings and, more particularly, to concrete slabs made in cast sections which are fitted end to end.

BACKGROUND OF THE INVENTION

Many buildings, especially single homes, are exposed to such hazards as rainwater leaking into the basement, termites and other insects entering, and vegetation growing too close.

In the past, numerous devices have been implemented to solve these problems, usually requiring special equipment and specially trained people at relatively high cost. This invention is an improvement in, and a combination of such devices.

OBJECTS AND ADVANTAGES

An object of this invention is to provide a shield which will simultaneously deflect rainwater, restrict vegetation and help prevent termites and other insects from entering a building.

An other object is to provide a shield which will not move away from a building in heavy rain or thawing conditions. A further object is to provide a shield which will extend the effectiveness of termite protection chemicals, while at the same time preventing such chemicals from polluting the environment.

Still another object is to provide a shield of this character which is simple and durable in construction, economical to manufacture, compact to ship and to store, and easy and quick to install.

DRAWING REFERENCE NUMERALS

| | |
|---|---|
| 10 Slab | 32 Ground Level |
| 12 Upper Surface | 34 Channel Cut in Earth |
| 14 Lower Surface | 36 Gauge Block |
| 16 End Face | 38 Outer Side of Gauge Block |
| 18 End Face | 40 Inner Side of Gauge Block |
| 20 Outer Face | |
| 22 Inner Face | |
| 24 Toe | |
| 26 Inner Side of Toe | |
| 28 Outer Side of Toe | |
| 30 Building Base | |

DETAILED DESCRIPTION OF THE PREFERRED EMBODIMENT

Figure 1:
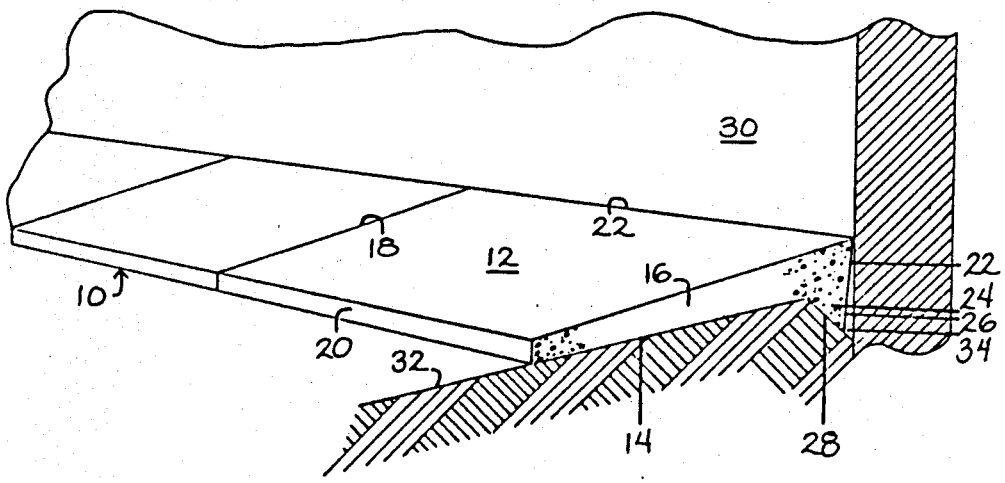
FIG. 1 is a perspective view of the invention installed along the base of a building.
Figure 2:
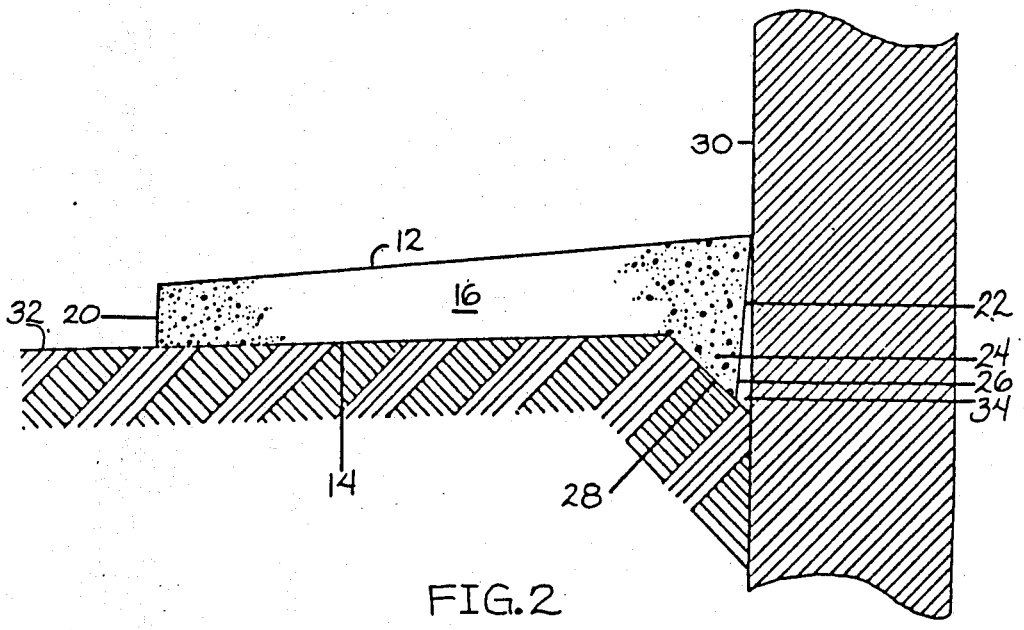
FIG. 2 is a view in crossection of the lower portion of FIG. 1.

Referring to FIG. 1, there is shown a slab 10 which is made of preformed concrete material and which includes a sealed upper surface 12 treated with a concrete-sealer, a lower surface 14, vertical end faces 16 and 18, an outer face 20, an inner face 22 and a toe 24 on the inner edge of the lower surface 14, extending between end faces 16 and 18, having an inner side 26 and an outer side 28. The inner face 22 of the slab is at an obtuse angle in relationship to the lower surface 14, permitting close contact of the upper edge of inner face 22 with the building base 30 at various angles of the ground level 32. The upper surface 12 is sloped to deflect rainwater away from the building base 30. The toe 24 rests in a V-shaped channel 34, cut into the earth to resist movement of the slab away from the building base.

Figure 3:
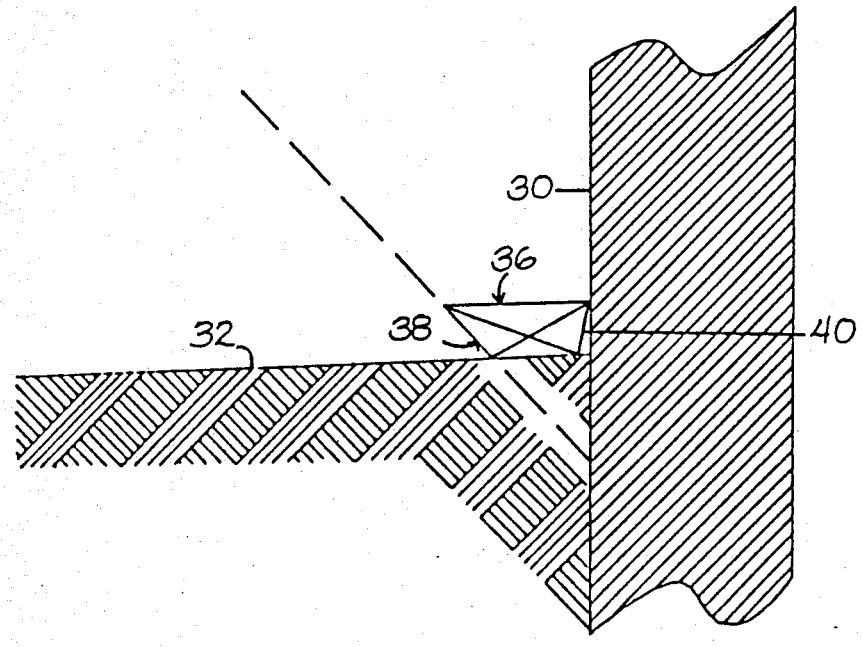
FIG. 3 is a view in crossection of a gauge block in position for use.
Figure 4:
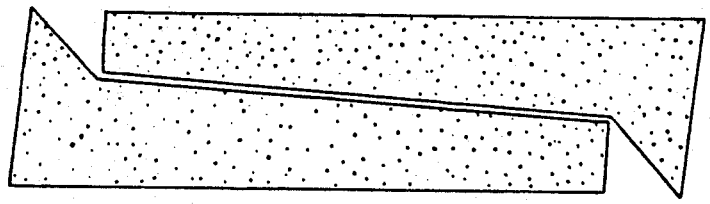
FIG. 4 is a side elevational view of two slabs in interlocked position for shipment and storage.

Referring to FIG. 3, there is shown an elongate gauge block 36, made of wood, having an outer side 38 angled to correspond with the angle of the outer side 28 of the toe 24. The inner side 40 of the gauge block is angled to correspond with the angle of the inner side 26 of the toe 24. The width of the gauge block is predetermined and constant. A garden spate or similar flat tool is inserted along the outer side 38 of the gauge block at an angle equal to the angle of outer side 38 to produce a channel of proper width and depth to receive the toe 24. The depth of this channel is also the proper depth and location for installing termite protection chemicals. After such chemicals have been applied to the bottom of the channel, the slabs are laid in tight formation along the building base forming an effective and lasting water-, termite- and vegetation barrier.

I claim:

1. A shield to protect the base of a building comprising: a rigid slab having a sealed upper surface a lower surface to rest on the ground, similarly shaped and sized opposite end surfaces for abutting relation with similar slabs, an inner building abutting face and an oppositely facing outer face, a V-shaped toe on the lower surface, adjacent the building and extending between the end surfaces, said V-shaped toe resting in a channel cut into the earth adjacent to the building to resist movement of the slab, wherein said inner surface is at an obtuse angle in relationship to the lower surface to insure close contact of an upper edge of the inner face with the base of the building.

2. A shield to protect the base of a building comprising: a slab having a sealed upper surface, a lower surface to rest on the ground, similarly shaped and sized opposite end surfaces for abutting relationship with similar slabs, an inner building abutting face and an oppositely facing outer face, a V-shaped toe on the lower surface, adjacent the building and extending between the end surfaces, said V-shaped toe having an inner side adjacent the building and an oppositely facing outer side, said V-shaped toe resting in a channel cut into the earth adjacent the building to resist movement of the slab, a gauge block having an inner and an outer side, wherein the shape and size of said channel is to be determined by the use of the gauge block, said gauge block having the outer side angled to correspond with the angle of the outer side of said toe, the inner side of said gauge block to correspond with the inner side of said toe and said gauge block being of predetermined width to produce a channel of proper shape and size to receive said toe.

* * * * *